US006314841B1

(12) United States Patent
Burk et al.

(10) Patent No.: US 6,314,841 B1
(45) Date of Patent: Nov. 13, 2001

(54) MULTI-PURPOSE HAND TOOL

(76) Inventors: Larry K. Burk, 1395 Oeth Ct., Dubuque, IA (US) 52003; Raymond S. Hodyniak, Jr., 11261 Erica Ct., Roscoe, IL (US) 61073; Michael R. Bloom, 11845 Winslow Rd., Durand, IL (US) 61024

( * ) Notice: Subject to any disclaimer, the term of this patent is extended or adjusted under 35 U.S.C. 154(b) by 0 days.

(21) Appl. No.: 09/535,895

(22) Filed: Mar. 27, 2000

(51) Int. Cl.[7] ..... B25B 13/00
(52) U.S. Cl. ..... 81/125.1; 81/124.2; 81/124.4
(58) Field of Search ..... 81/125.1, 124.2, 81/124.4

(56) References Cited

U.S. PATENT DOCUMENTS 4,291,425 * 9/1981 Sweitzer .
5,186,083 * 2/1993 Hsiao .
5,542,321 * 8/1996 Fuca .
5,557,992 * 9/1996 Macor .

OTHER PUBLICATIONS

Richard Specialty Co, Inc. Catalog, 1997, p. 12, (Closet Seat Wrench).

* cited by examiner

*Primary Examiner*—Timothy V. Eley
*Assistant Examiner*—Willie Berry, Jr.
(74) *Attorney, Agent, or Firm*—Zarley, McKee, Thomte, Voorhees & Sease

(57) ABSTRACT

A hand tool includes an elongated substantially rigid body having generally opposite first and second ends. The first end has a first socket of a given width and depth formed longitudinally therein. A first slot extends longitudinally into the first end and across the first socket. The first slot has a width less than the width of the first socket. The second end has a second socket formed therein which also extends longitudinally. The first and second sockets can be of different widths and depths. This hand tool is useful on projects where a variety of fastener sizes and types are encountered.

16 Claims, 2 Drawing Sheets

MULTI-PURPOSE HAND TOOL

BACKGROUND OF THE INVENTION

The present invention relates to the field of hand tools. More particularly, this invention relates to a compact nonmetallic hand tool having a plurality of different fastener-engaging cavities. The invention is especially useful for plumbing work.

Combination wrenches having sockets or cavities on both ends for receiving nuts, bolts or screw heads are well known. However, such combination wrenches are typically constructed of metal for strength and durability. A problem arises when using metallic wrenches around glass, ceramic and porcelain materials like typically found in plumbing fixtures. If the wrench slips and contacts the plumbing fixture, the surface of the fixture can become damaged or marred. Furthermore, space around plumbing fixtures is often limited to such a degree that the worker can barely get a hand in the vicinity of the fastener.

A variety of fasteners are used on plumbing fixtures. For instance, on a toilet or water closet one can find one size hexagonal head bolt for securing the tank to the floor, another size hexagonal head bolt for securing the toilet bowl to the tank, yet another size bolt or nut for securing the seat to the bowl, and perhaps even a wing nut or two. It would be handy and efficient if one compact nonmetallic tool could be used on all of these fasteners without marring or otherwise damaging the fixture.

Therefore, a primary objective of the present invention is the provision of a compact multi-purpose hand tool.

Another objective of this invention is the provision of a nonmetallic hand tool having a plurality of cavities therein for correspondingly receiving and engaging different types of fasteners.

Another objective of this invention is the provision of a hand tool which can be economically produced by conventional plastic injection molding techniques.

Another objective of this invention is the provision of a hand tool which will not mar glass, ceramic, or porcelain surfaces.

Another objective of this invention is the provision of a hand tool that will yield before the fastener which it engages, thereby preventing the fastener from being broken by excessive torque.

Another objective of this invention is the provision of a hand tool which is economical to produce, durable, and reliable in use.

SUMMARY OF THE INVENTION

The present invention relates to a hand tool which includes an elongated substantially rigid body having generally opposite first and second ends thereon. The first end has a first socket of a given nominal width thereacross and a given depth formed longitudinally therein. A first slot extends longitudinally into the first end and transversely across the first socket. The first slot has a width less than the nominal width of the first socket. The second end has a similar second socket formed therein. The sockets can be of different sizes and additional slots can be added.

This hand tool is particularly useful for a toilet having at least two different fasteners thereon. The first socket is adapted to operatively mate with and engage a first fastener and the second socket is adapted to mate with and engage a second fastener on the toilet.

DETAILED DESCRIPTION OF THE PREFERRED EMBODIMENT

Figure 1:
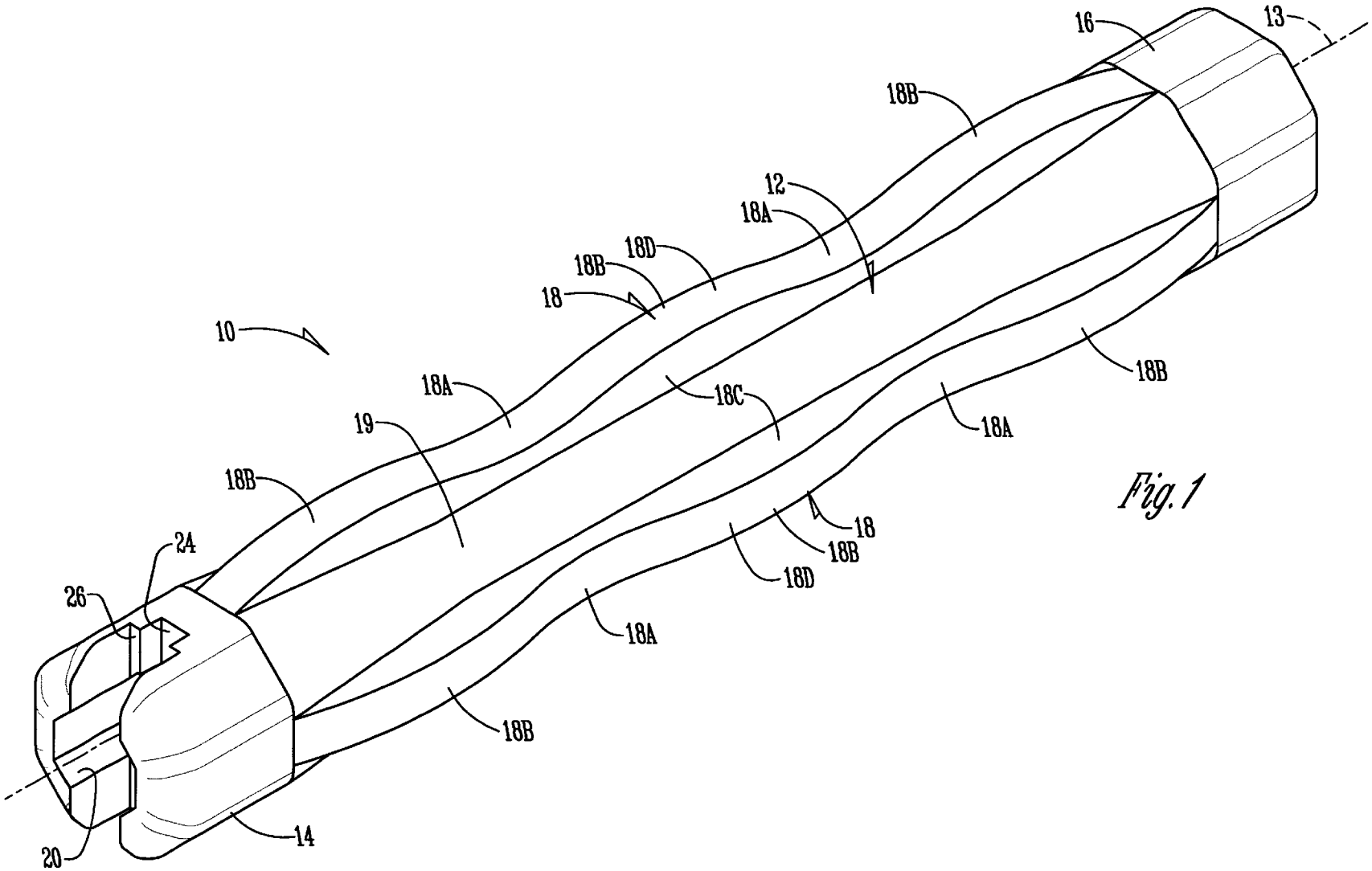
FIG. 1 is a perspective view of the hand tool of the present invention.

In the figures and the description which follows, the hand tool of this invention is designated by the reference numeral 10. Referring to FIG. 1, the hand tool 10 includes a body portion or hand grip portion 12 which has a central longitudinal axis 13. The hand tool 10 includes a first end 14 and a second end 16 generally opposite of the first end and aligned therewith along the central longitudinal axis 13. The body 12 is substantially rigid and includes a plurality of spaced apart raised ribs 18 thereon. The ribs 18 have a generally sinusoidal profile comprised of alternating elevated and lowered portions 18A, 18B which rise and fall with respect to the outer periphery 19 of the body 12. Each of the ribs 18 includes a pair of upright sides 18C and a substantially horizontal surface 18D interconnecting them. The ribs 18 extend longitudinally between the first and second ends 14, 16. Preferably the ribs 18 are spaced apart by approximately 90° around the outer periphery 19 of the body 12. The ribs 18 provide an excellent structure for allowing the hand tool 10 to be gripped by the human hand.

Figure 3:
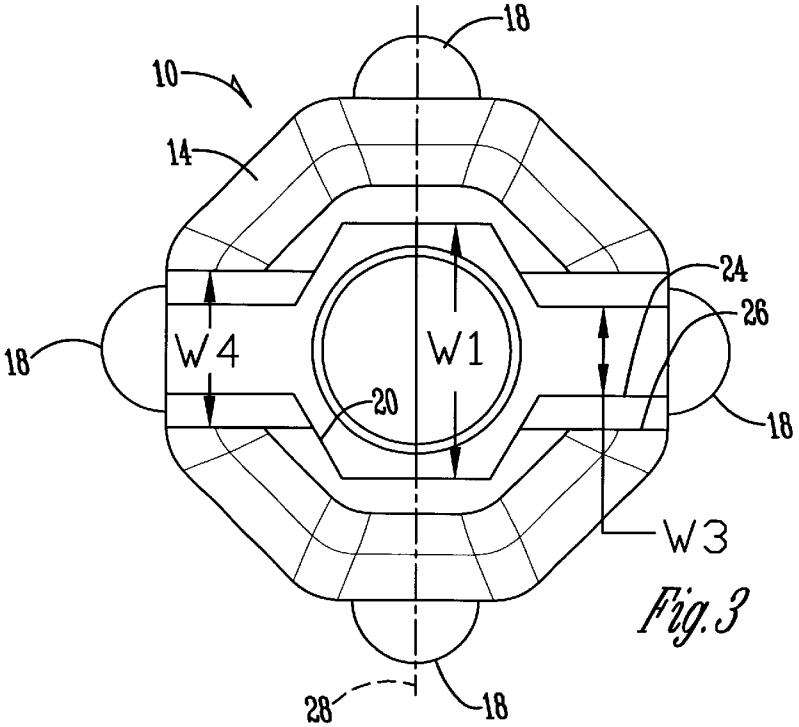
FIG. 3 is an end view of the right end of the hand tool of FIG. 2.
Figure 4:
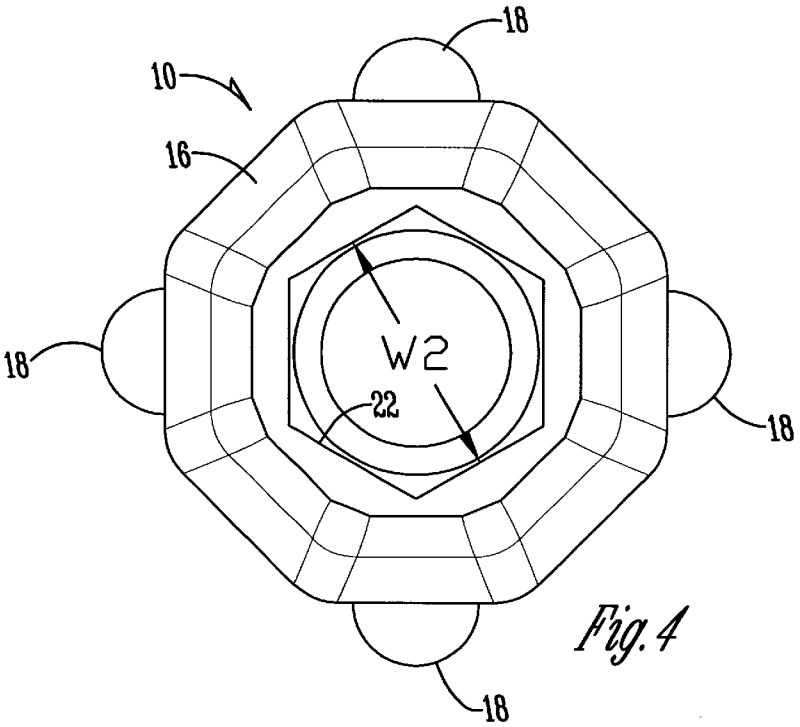
FIG. 4 is an end view of the left end of the hand tool of FIG. 2.

The first end 14 has a first socket 20 formed therein. The first socket 20 can be formed to a given nominal width W1 and a given depth. Similarly, the second end 16 has a second socket 22 of a given nominal width and depth formed therein. Preferably the second socket 22 has a nominal width W2 which is different than the nominal width W1 of the first socket 20. Although other configurations will suffice depending upon the particular fasteners to be engaged, the first and second sockets 20, 22 are preferably hexagonal sockets formed by a plurality of interconnected side walls. As best seen in FIGS. 3 and 4, the first and second ends 14, 16 have octagonal outer peripheries, as well.

Figure 2:
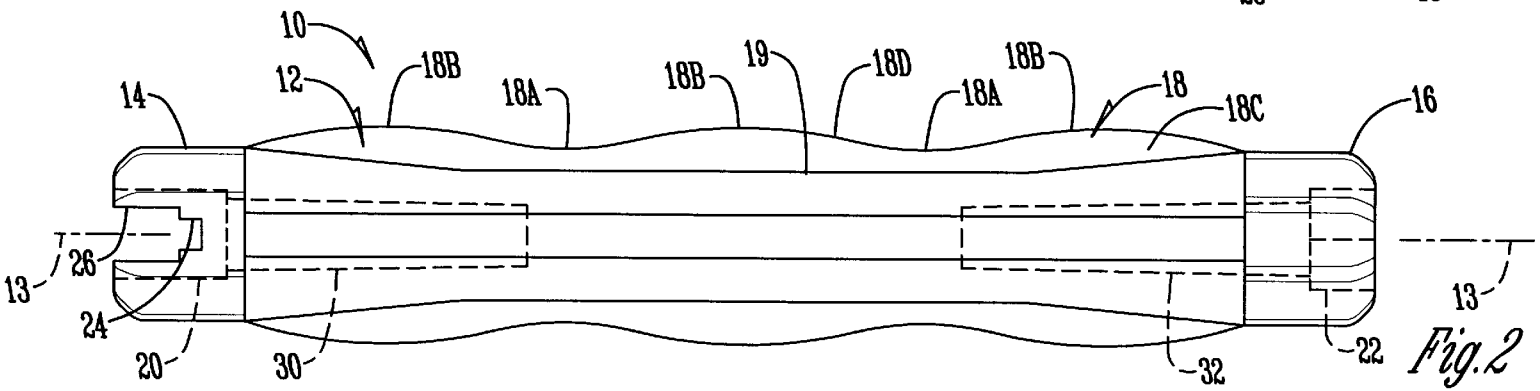
FIG. 2 is a front (longitudinal) elevation view of the hand tool of FIG. 1.

As best seen in FIGS. 2 and 3, the first end 14 of the body 12 also includes an inner slot 24 which is preferably generally registered with at least some of the side walls of the socket 20. The inner slot 24 has a predetermined or given width W3 and depth. Preferably the depth of the inner slot 24 is approximately equal to the depth of the first socket 20. An outer slot 26 of a given width W4 and depth can be formed in the first end 14 of the body 12. The outer slot also generally registers with at least some of the side walls of the socket 20. The inner and outer slots 24, 26 extend transversely across the socket along a common axis 28 which is central to both of the slots 24, 26 and perpendicular to axis 13. The slots 24, 26 extend longitudinally into the first end 14 and transversely across the first socket 20. The width W4 of the outer slot 26 is greater than the width W3 of the inner slot 24, but less than the nominal given width W1 of the first socket 20. Thus, the width W3 of the inner slot 24 is also preferably less than the given nominal width W1 of the first socket 20. The inner slot 24 extends deeper into the first end 14 than the outer slot 26 so as to receive and sufficiently engage a wing nut or the like. Similarly, the outer slot is adapted to receive and engage a larger wing nut.

The elongated substantially rigid body 12, and preferably the entire hand tool 10, should be formed of a nonmetallic material. Because it can easily be molded, a plastic resin material is preferred, but almost any strong, durable nonmetallic material will suffice to avoid marring plumbing fixtures and the like.

This hand tool 10 is useful in plumbing work. The hand tool 10 can be used to loosen or tighten various fasteners normally found on a toilet or water closet. One of the many possible sizes of the hand tool 10 includes a first end 14 having a 0.513 inch wide (W1) first socket 20 (for a 7/16 nut), a 0.178 inch wide (W3) inner slot 24, a 0.313 inch wide (W4) outer slot 26, and a 0.445 inch wide (W2) second socket 22 (for a ½ inch nut). The first socket 20 is approximately 0.563 inches deep. The second socket 22 is approximately 0.375 inches deep. The inner slot 24 and the outer slot 26 are 0.563 inches deep and 0.438 inches deep, respectively. The hand tool 10 of this example is made of polypropylene by conventional plastic injection molding techniques.

In use, the hand tool 10 is adapted to operatively mate with and engage two different fasteners on a toilet. For instance, one end of the hand tool 10 can be used on the screws or bolts which fasten the toilet bowl to the floor, and another end of the tool can be used on the screws or bolts which fasten the seat to the bowl. The tool 10 also facilitates attachment of the tank to the toilet bowl by allowing the user to engage the studs and nuts associated with those components. The slots 24, 26 are useful when wing nuts are used on the toilet.

Thus, it can be seen that the present invention at least achieves its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention.

What is claimed is:

1. A hand tool comprising:

an elongated substantially rigid body having generally opposite first and second ends thereon;

the first end having a first socket of a given nominal width thereacross and a given depth formed longitudinally therein;

a first slot extending longitudinally into the first end and transversely across the first socket, the first slot having a width less than the given nominal width of the first socket;

the second end having a second socket formed therein and extending longitudinally;

the first end further including a second slot extending longitudinally into the first end and transversely across the first socket, the second slot having a width greater than the width of the first slot and less than the given nominal width of the first socket.

2. The hand tool of claim 1 wherein the first slot has a depth approximately equal to the given depth of the first socket.

3. The hand tool of claim 1 wherein second socket has a nominal width different than the nominal width of the first socket.

4. The hand tool of claim 1 wherein the first slot extends deeper into the first end of the body than the second slot.

5. The hand tool of claim 1 wherein the first and second slots extend across the socket along a common axis which is central to both the first and second slots.

6. The hand tool of claim 1 wherein the first and second sockets are hexagonal sockets formed by a plurality of interconnected side walls.

7. The hand tool of claim 1 wherein the body is formed of a nonmetallic material.

8. The hand tool of claim 7 wherein the body is formed of a plastic resin material.

9. The hand tool of claim 1 wherein the first and second ends each have an octagonal outer periphery in a transverse cross section.

10. The hand tool of claim 1 wherein the body has a central longitudinal axis and the first and second sockets extend along the central longitudinal axis.

11. The hand tool of claim 1 comprising a plurality of spaced apart raised ribs protruding from the elongated body.

12. The hand tool of claim 11 wherein the ribs extend longitudinally between the first and second ends.

13. The hand tool of claim 11 wherein the body has central longitudinal axis and an outer periphery extending between the ends, the ribs being spaced apart by approximately 90 degrees around the outer periphery.

14. The hand tool of claim 11 wherein the ribs have a substantially sinusoidal profile having alternating elevated and lowered portions therealong which rise and fall with respect to the outer periphery of the body.

15. The hand tool of claim 11 wherein the ribs comprise a pair of upright sides and a substantially horizontal surface interconnecting the upright sides.

16. A hand tool comprising:

an elongated substantially rigid body having generally opposite first and second ends thereon;

the first end having a first socket of a given nominal width thereacross and a given depth formed longitudinally therein;

a first slot extending longitudinally into the first end and transversely across the first socket, the first slot having a width less than the given nominal width of the first socket;

the second end having a second socket formed therein and extending longitudinally;

the first and second sockets being hexagonal sockets formed by a plurality of interconnected side walls;

the first and second slots generally registering with at least some of the side walls of the sockets.

* * * * *